US008429939B2

(12) United States Patent
Suel, II et al.

(10) Patent No.: US 8,429,939 B2
(45) Date of Patent: Apr. 30, 2013

(54) STATIC BASKET WASHING MACHINE

(75) Inventors: Richard Dean Suel, II, Louisville, KY (US); Mark A. Didat, Floyds Knobs, IN (US); Edward S. Chupka, Bardstown, KY (US); Timothy T. Hertrick, Canton, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/111,404

(22) Filed: May 19, 2011

(65) Prior Publication Data

US 2012/0291496 A1 Nov. 22, 2012

(51) Int. Cl.
*D06F 39/12* (2006.01)
*D06F 17/10* (2006.01)

(52) U.S. Cl.
USPC ..... 68/134

(58) Field of Classification Search ..... 68/134
See application file for complete search history.

(56) References Cited

U.S. PATENT DOCUMENTS 4,744,228 A 5/1988 Goldberg
7,637,129 B2 12/2009 Wang

FOREIGN PATENT DOCUMENTS

CN 101153436 A * 4/2008
JP 08-103593 * 4/1996
JP 11-300080 * 11/1999

OTHER PUBLICATIONS

English machine translation ofJP11-300080 to Kenjo et al.*
English machine translation ofJP08-103593 to Kenjo et al.*

* cited by examiner

*Primary Examiner* — Michael Barr
*Assistant Examiner* — Jason Riggleman
(74) *Attorney, Agent, or Firm* — Dority & Manning, P.A.

(57) ABSTRACT

A washing machine appliance, such as a consumer washing machine, includes a casing, and a tub disposed within the casing. A wash basket is received within the tub and is configured for receipt of articles to be washed. A diffuser plate defines a continuous bottom of the wash basket and includes a plurality of passages defined therethrough. An impeller system is operably configured within the tub below the diffuser plate and includes at least one impeller that is rotationally driven during a wash cycle to direct high velocity wash water through the passages with sufficient energy to move and wash articles within the wash basket.

8 Claims, 5 Drawing Sheets

FIG. –1–

STATIC BASKET WASHING MACHINE

FIELD OF THE INVENTION

The present subject matter relates generally to washing machine appliances, and more particularly to a washing machine that does not use a mechanical agitator in the wash basket.

BACKGROUND OF THE INVENTION

Conventional residential washing machines typically utilize a mechanical agitator or pulsator within the clothes basket. This device takes up valuable space within the wash basket and, thus, reduces the volume of articles that can be loaded into the machine. In addition, significant energy is required to rotate or drive the agitator and the machine motor must be designed to handle the increased load of the agitator.

Attempts have been made to eliminate the agitator from residential washing machines. For example, U.S. Pat. No. 4,744,228 describes a system wherein a venturi extends through the bottom of the wash basket and is supplied with water from a pump. The venturi directs the water in a circular flow path within the wash basket, and drain opening in the tub direct the water back to the pump. The basket sits on rollers within the tub and a magnetic drive is used to spin the wash basket during the various wash cycles.

U.S. Pat. No. 7,637,129 describes a washing machine that uses high pressure angled air jets to create a circular swirl flow of water within a stationary tub to agitate and clean the clothes without rotating the tub.

A commercially available agitator-less washing machine is available from Whirlpool™ under the "Cabrio" name. Instead of an agitator, this machine utilizes a movable wash plate in the bottom of the basket to rock the clothes during the wash cycle. Kenmore™ offers a similar machine referred to as the "Oasis."

Accordingly, the industry is continuously seeking improvements in washing machines that increase the load capacity by eliminating the central agitator while also reducing energy use and improving water management.

BRIEF DESCRIPTION OF THE INVENTION

Aspects and advantages of the invention will be set forth in part in the following description, or may be obvious from the description, or may be learned through practice of the invention.

In a particular embodiment, a washing machine appliance, such as a residential washing machine, has a casing and a tub disposed within the casing. A wash basket is received within the tub and is configured for receipt of articles to be washed. A diffuser plate defines a continuous bottom of the wash basket. In other words, the bottom is not interrupted by an agitator, pulsator, or other similar device. The diffuser plate includes a plurality of passages defined therethrough. An impeller system is operably configured within the tub below the diffuser plate and includes at least one impeller that is rotationally driven during a wash cycle to direct high velocity wash water through the passages in the diffuser plate with sufficient energy to move (e.g., agitate) and wash articles within said wash basket.

In a particular embodiment, the diffuser plate is stationary within the wash basket. In other words, the diffuser plate does not rotate, gyrate, or otherwise move relative to the wash basket. The diffuser plate may be a non-removable integral component of the wash basket. In another embodiment, the diffuser plate may be a removable accessory component that is placed by the consumer into the wash basket. For example, in this embodiment, the diffuser plate may also include side walls and define a tray or basket-type structure that is loaded with articles to be washed and placed into the wash basket by the consumer.

The plurality of passages may be variously configured within the diffuser plate to achieve different functionalities. For example, certain of the passages may be configured primarily for directing water from the impeller into the wash basket at a defined location and angle so as to generate a particular movement pattern in the articles within the wash basket. Other passages may be configured primarily for draining water from the wash basket back to the impeller. In other embodiments, the passages may be configured for uniformly directing water into the wash basket over essentially the entire surface area of the diffuser plate, with the water draining through holes in the circumferential side of the wash basket back to the impeller.

In still a further embodiment, any manner of flow-directing structure may be disposed between the diffuser plate and the impeller to direct water from the impeller into the wash basket at a defined location and angle so as to generate a particular movement pattern in the articles within said wash basket.

The impeller system may also be variously configured to achieve different functionalities. For example, the impeller system may utilize a single impeller having a blade configuration that generates flow generally uniformly through the surface area of the diffuser plate. In an alternate embodiment, the impeller system may utilize a single impeller with a blade configuration that generates flow through a defined circumferential region of the diffuser plate, for example the outer circumferential region of the plate. In still further embodiments, the impeller system may utilize a plurality of impellers.

The wash basket may be rotationally driven, for example during the spin and drain cycles, as with conventional washing machine configurations.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWING

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
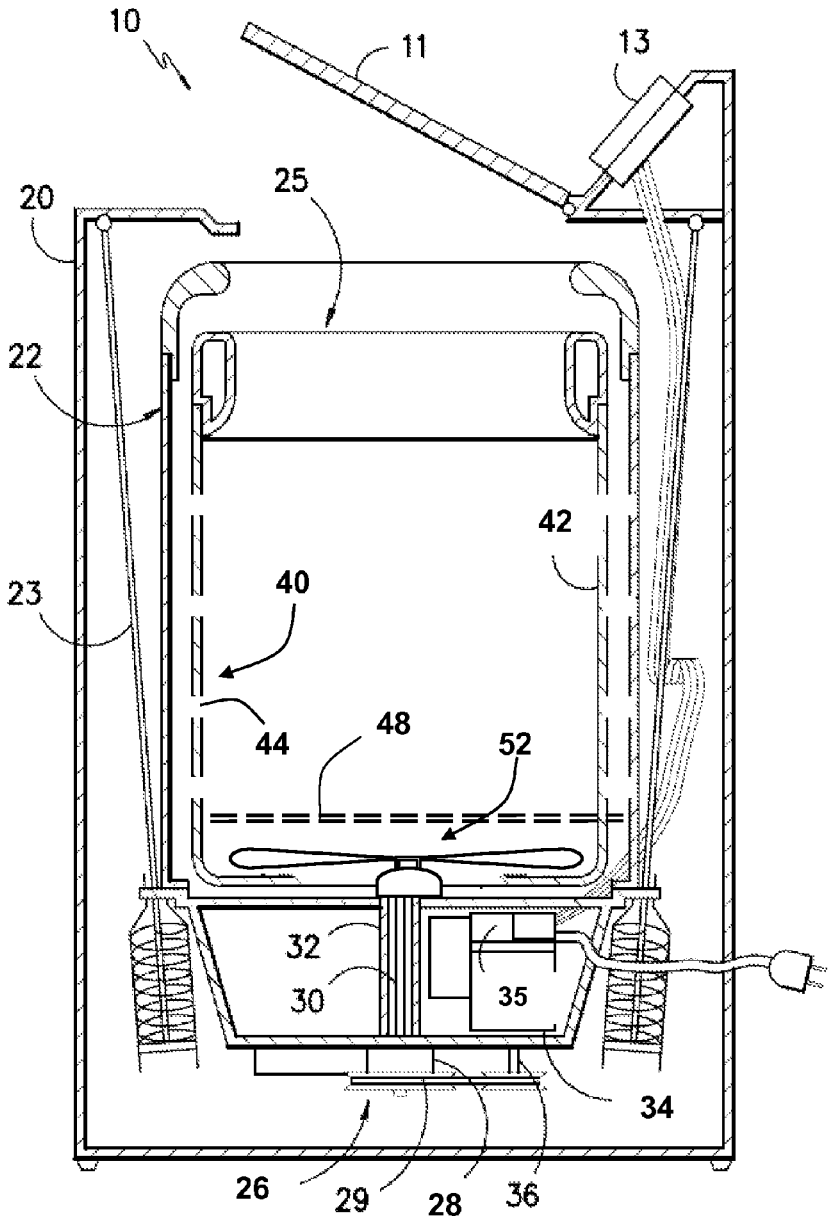
FIG. 1 is a side cut-away view of a washing machine that incorporates aspects of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a conventional washing machine 10 and is provided for illustrative purposes only to place the present invention in its working environment. It should be appreciated that that the invention is not limited to any particular type or style of washing machine 10. In general, such machines 10 are top-loading (as in FIG. 1) or front-loading through a door 11 and underlying receiving opening 25 into the wash basket 40. A control panel 13 is provided for selection and control of the various functionalities of the machine 10. The washing machine 10 has an external casing 20 and an internal tub structure 22 suspended with springs 23. The wash basket 40 is configured in the drum 22 and is driven by a motor 34 via a drive arrangement 26. The motor is controlled by a controller 35.

The drive arrangement 26 may include any manner of drive components. For example, a pulley may be mounted to a motor driveshaft 36, which is connected by a belt 29 to a pulley that is mechanically linked to an impeller driveshaft 30 and a spin tube 32. The driveshaft 30 drives an impeller 54 in various modes of operation, as discussed in greater detail below. The spin tube 32 may be directly coupled to the wash basket 40 for rotating the basket in various modes of operation. A clutch (or clutches) 28 may be configured with the drive arrangement 26 to allow for independent rotation of the impeller drive shaft 30 relative to the spin tube 32.

It should be appreciated that the invention is not limited to any particular drive arrangement 26, and that any suitable configuration of drive components are within the scope and spirit of the invention.

Figure 3:
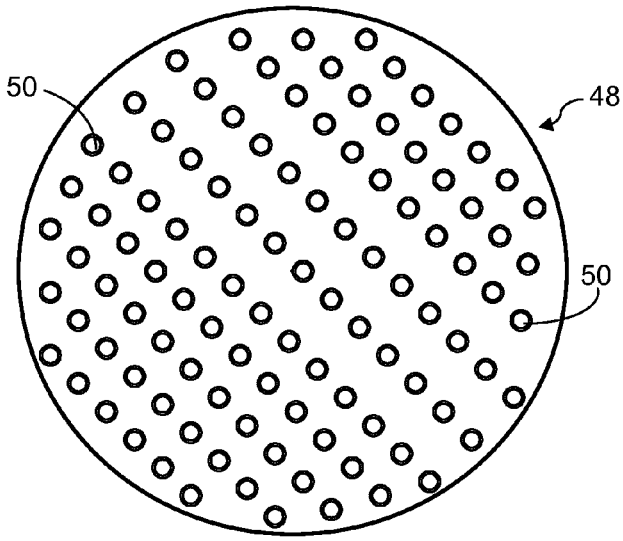
FIG. 3 is a view of an embodiment of a diffuser plate.

Referring to FIGS. 1 and 3 in general, the washing machine 10 incorporating aspects of the invention includes a diffuser plate 48 that defines a continuous bottom of the wash basket 40. The diffuser plate 48 is "continuous" in that it is not broken by an agitator, pulsator, or other similar device typically used in conventional washing machines for agitating the clothes or other articles placed in the basket 40. Thus, the internal useful volume of the wash basket 40 is significantly increased. The diffuser plate 48 includes any number and pattern of passages 50 defined therethrough, as particularly indicated in FIG. 3.

An impeller system 52 is operably configured within the tub 22 below the diffuser plate 48. The impeller system 52 includes at least one impeller 54 that is rotationally driven by the impeller drive shaft 30, as discussed above, during at least one wash cycle. The impeller 54 uses impeller blades 56 to generate and direct high velocity water through the passages 50 in the diffuser plate 48 with sufficient energy to move (i.e., agitate) and wash clothes articles placed within the basket 40.

Figure 2:
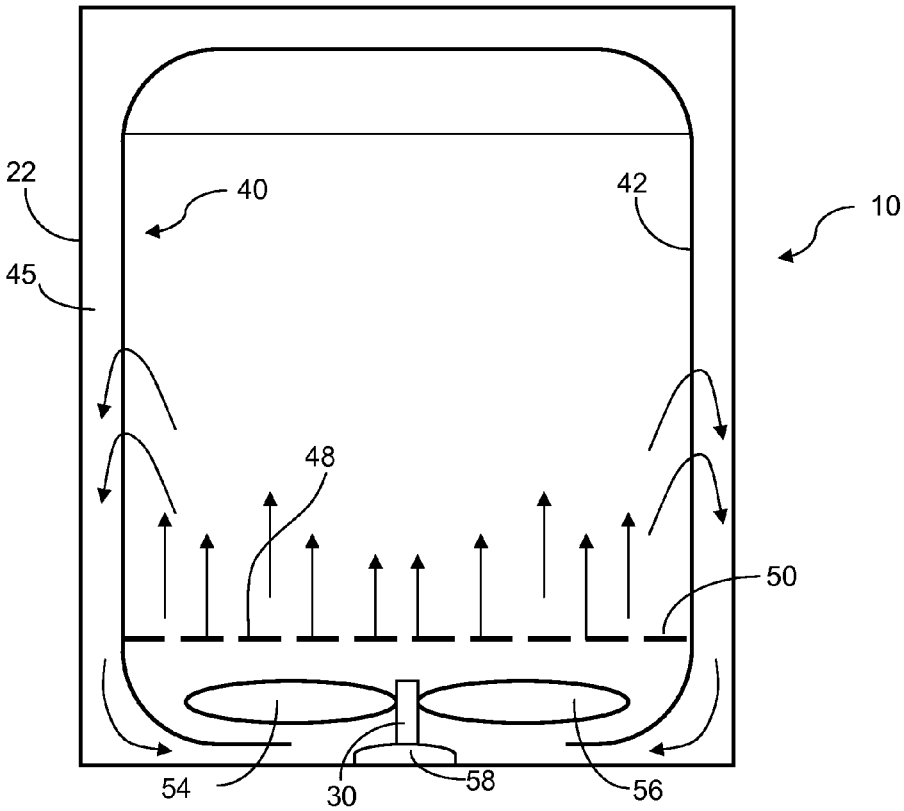
FIG. 2 is a side diagrammatic view of an embodiment of a washing machine that incorporates an impeller drive system and diffuser plate.

In particular embodiments, the diffuser plate 48 is stationary within the wash basket 40. In other words, the diffuser plate 48 does not rotate, gyrate, or otherwise move relative to the wash basket 40. The diffuser plate 48 may be a non-removable, integral component of the wash basket 40, for example as depicted in FIGS. 1 and 2. In these embodiments, the wash basket 40 includes a circumferential side wall 42 that may, in certain embodiments, extend down below the diffuser plate 48 and at least partially enclose the impeller 54. A space 45 is defined between the circumferential side wall 42 of the wash basket 40 and the surrounding tub 22. Drain holes 44 may be defined in the circumferential side wall 42 of the basket 40 for water to drain from the wash basket 40 into the space 45, wherein the water is directed back to the impeller 54, as indicated by the arrows in FIG. 2.

Figure 9:
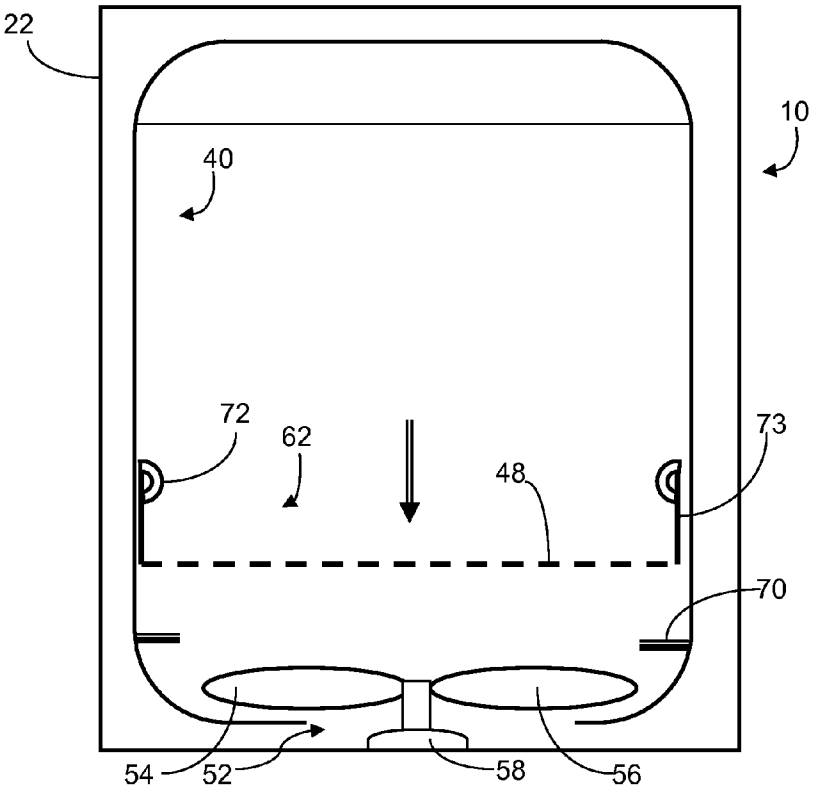
FIG. 9 is side diagrammatic view of an alternative embodiment wherein the diffuser plate is incorporated in a removable structure.

In yet a different embodiment depicted for example in FIG. 9, the diffuser plate 48 may be a component of a removable accessory-type element 62. This element 62 may define, for example, a basket or tray-like structure having a side wall 73 and handles 72. This structure 62 may allow for the operator to load clothes or other articles to be washed into the structure 62, which is then placed into the wash basket 40 to rest or otherwise be engaged by a circumferential ledge 70, or any other suitable structure for retaining the tray-like structure 62 within the wash basket 40 above the impeller 54.

It should be appreciated that the plurality of passages 50 may be variously configured within the diffuser plate 48 in order to achieve different desired functionalities. For example, the passages 50 may be configured so as to direct water from the impeller 54 at a defined location and angle so as to generate a particular movement pattern in the articles within the wash basket 40. For example, the passages 50 may have an angular orientation in the diffuser plate 48 so as to direct the water stream circumferentially outward against the side wall 42 of the basket. This configuration may result in the clothes or other articles in the wash basket being agitated in a generally vertical circular motion wherein the clothes are conveyed vertically upwards along the side wall 42 and downwards in a center portion of the wash basket 40.

In the embodiment of FIGS. 2 and 3, the plurality of passages 50 are oriented so as to essentially uniformly distribute the water from the impeller 54 through the entire surface area of the diffuser plate 48, as indicated by the arrows in FIG. 2. In this particular embodiment, the primary drain path for the water back to the impeller 54 would be through the drain holes 44 (FIG. 1) in the circumferential side 42 of the wash basket, as indicated in FIG. 2.

Figure 4:
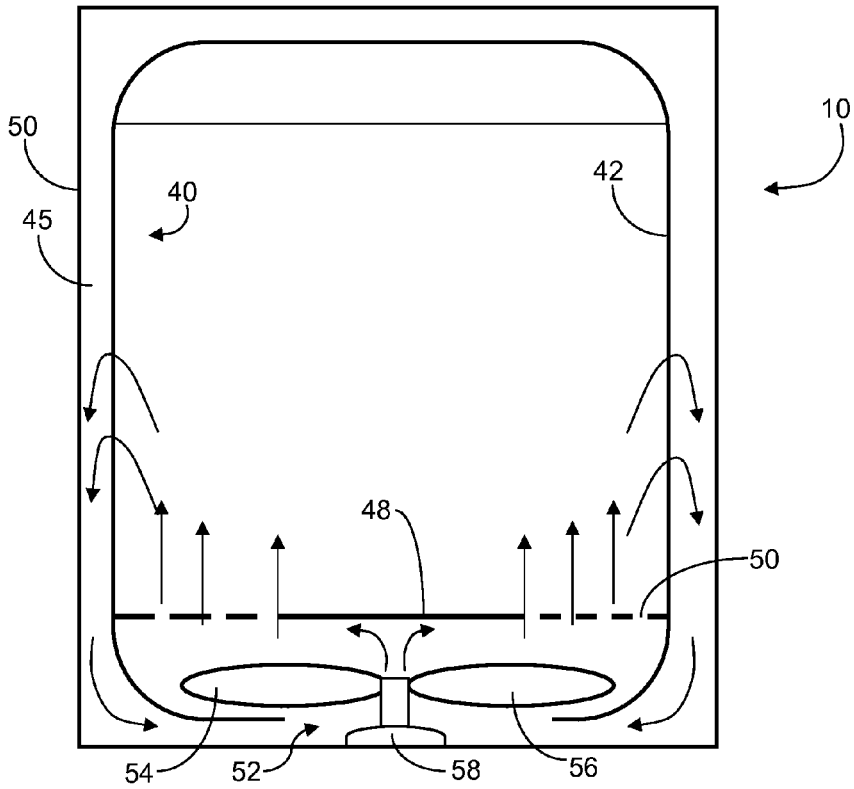
FIG. 4 is a side diagrammatic view of an alternative embodiment of a washing machine with an impeller drive system and diffuser plate.
Figure 5:
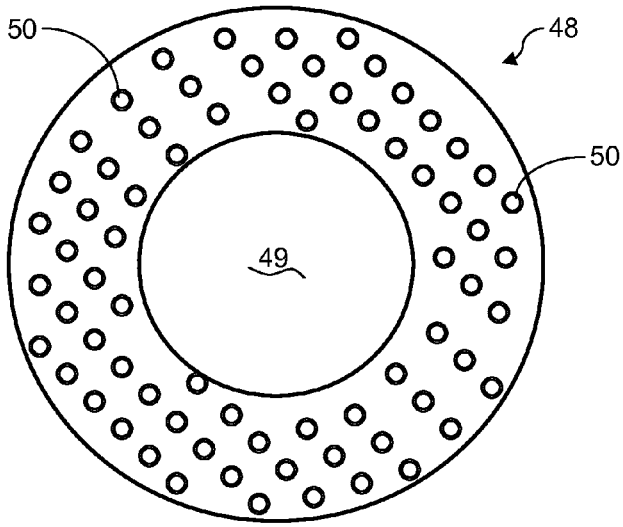
FIG. 5 is a view of an alternative diffuser plate.

In the embodiment of FIGS. 4 and 5, the diffuser plate 48 includes a center region 49 that is void of the passages 50 so that water from the impeller 54 cannot be directed through the center region. Thus, in this particular embodiment, the substantial portion of the water from the impeller 54 is directed through the passages 50 in the outer circumferential region of the diffuser plate 48, as depicted by the arrows in FIG. 4. This particular configuration may further enhance a vertical churning or rotation of the clothes articles within the wash basket 40, as discussed above.

Figure 6:
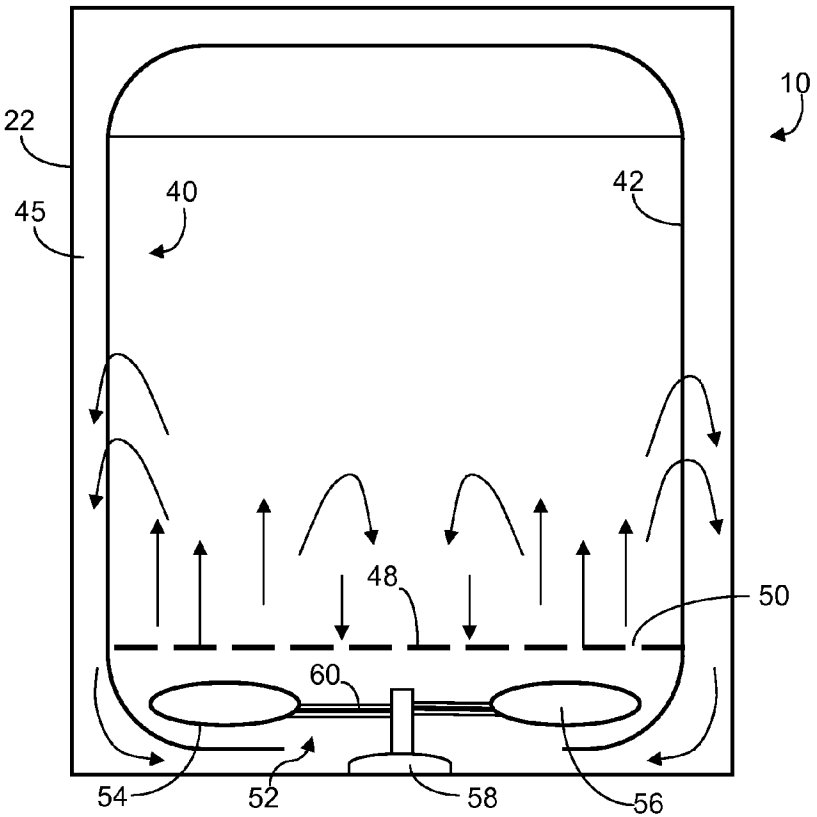
FIG. 6 is a side diagrammatic view of still another embodiment of a washing machine with an impeller drive system and diffuser plate.

Referring to FIG. 6, certain of the passages 50 in the diffuser plate 48 may be configured primarily for draining water back to the impeller 54. In this embodiment, the impeller system 52 includes radial extensions 60 extending from the hub 58. These extensions 60 are void of impeller blades 56 or other type of structure that would generate any meaningful flow of water through the passages 50 in the center region of the diffuser plate 48. Thus, these center region passages will allow drainage of water from the wash basket 40 back to the impeller 54. The radially outboard blades 56 will cause the substantial portion of the water flow generated by the impeller 54 to flow through the outer circumferential region of passages 50 in the diffuser plate 48, as indicated by the arrows in FIG. 6. A portion of the water from the wash basket 40 may also drain through the circumferential side 42 back to the impeller 54, as indicated in FIG. 6.

Figure 7:
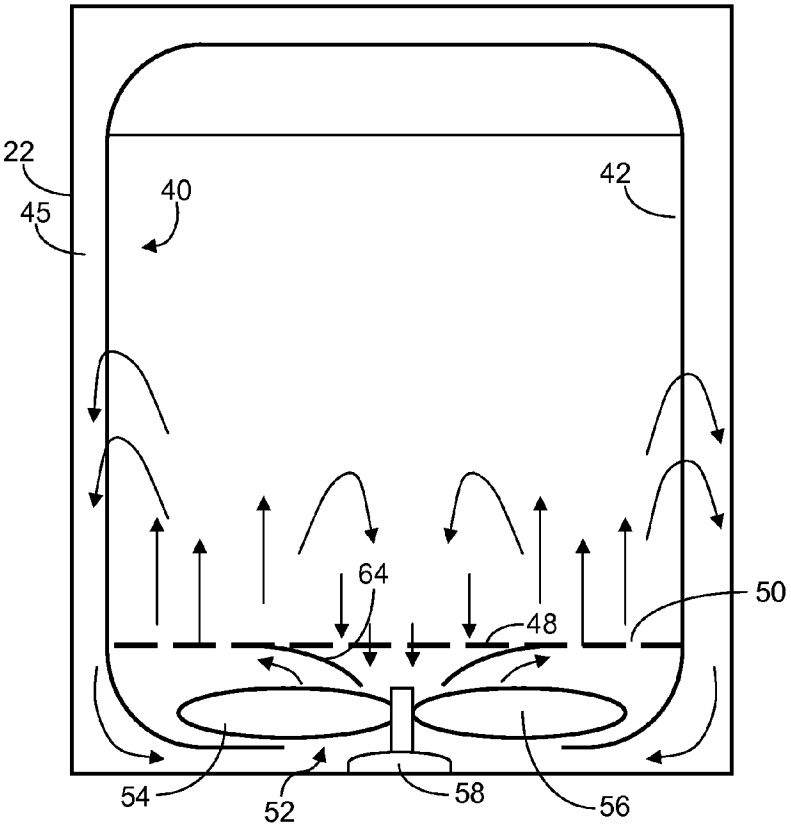
FIG. 7 is a side diagrammatic view of an embodiment of a washing machine with an impeller drive system with flow structure and a diffuser plate.

In the embodiment of FIG. 7, the impeller system 52 includes an impeller 54 configured with blades 56 that extend from the hub 58 such that essentially the entire radial component of the blades 56 will generate a flow of water towards the diffuser plate 48, as in the embodiment of FIG. 2. However, any manner of flow structure 64 may be configured between the diffuser plate 48 and the impeller 54 to direct the flow of water to any desired region of the diffuse plate 48. In the embodiment of FIG. 7, the structure 64 includes a conical-type member that directs the flow of water towards the outer circumferential region of the diffuser plate 48, as indicated by the arrows in FIG. 7. Thus, the center region of passages 50 may serve primarily for draining water back to the impeller 54, as well as the drain openings 44 (FIG. 1) in the circumferential side wall 42 of the basket 40.

The impeller system 52 may include any manner of suitable impeller configuration. For example, in the embodiment of FIG. 2, a single impeller 54 is utilized, wherein the impeller 54 includes opposite radial blades 56. It should be appreciated that any number of blades 56 may be configured relative to the hub 58, such as three blades, four blades, and so forth. In FIG. 2, the blades 56 are configured so as to generate a generally uniform flow through the entire surface area of the diffuser plate 48.

Figure 8:
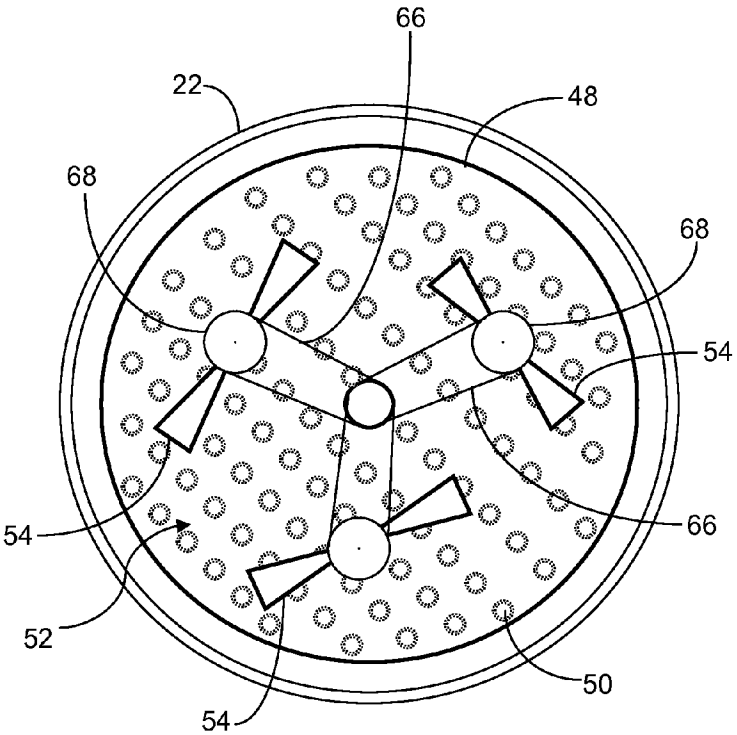
FIG. 8 is a top view through the diffuser plate of an embodiment wherein the impeller drive system incorporates multiple impellers.

In an alternative embodiment illustrated, for example, in FIG. 8, the impeller system 52 includes a plurality of separately driven impellers 54, wherein each impeller 54 includes two or more radially extending blades 56. The plurality of impellers 54 may be commonly driven by the drive shaft 30 (FIG. 1) via any manner of suitable transmission arrangement. In the illustrated embodiment, each of the impellers 54 is configured with a pulley 68 that is driven by a respective belt 66. The belt 66 is, in turn, engaged by any suitable means with the drive shaft 30. In this embodiment, the various impellers 54 may have a size or other configuration so as to generate different volumetric flow rates of water through the diffuser plate 48, and so forth.

It should be appreciated that the wash basket 40 may be rotationally driven by the drive arrangement 26 (FIG. 1) and spin tube 32, as discussed above, for various wash cycles. For example, the wash basket 40 may be rotationally driven during the spin cycle or rinse cycle, as is conventionally known in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a casing;

a tub disposed within said casing;

a wash basket received within said tub and configured for receipt of articles to be washed;

a diffuser plate that defines a continuous bottommost surface of said wash basket upon which articles to be washed are supported in said wash basket, said diffuser plate further comprising a plurality of passages defined therethrough;

an impeller system operably configured within said tub below said diffuser plate, said impeller system including at least one rotationally driven impeller disposed below said diffuser plate at a location such that substantially all wash water is directed by said impeller system upwards through said passages in said diffuser plate during a wash cycle with sufficient energy to move and wash articles within said wash basket; and further comprising flow-directing structure disposed at a location between said diffuser plate and said impeller to block wash water from said impeller from passing through a defined group of said passages in said diffuser plate, said defined group of passages defining drains for the wash water from said wash basket.

2. The washing machine as in claim 1, wherein said diffuser plate is stationary within said wash basket.

3. The washing machine as in claim 2, wherein said diffuser plate is a non-removable integral component of said wash basket.

4. The washing machine as in claim 2, wherein said diffuser plate is a removable accessory component that is placeable within said wash basket by a consumer.

5. The washing machine as in claim 1, wherein said impeller system comprises a single said impeller.

6. The washing machine as in claim 1, wherein said impeller system comprises a plurality of impellers.

7. The washing machine as in claim 1, wherein said wash basket is rotationally driven relative to said impeller during certain cycles of the wash cycle.

8. The washing machine as in claim 1, further comprising a plurality of drain holes in the circumferential side through which the wash water drains back to said impeller.

* * * * *